US006220553B1

(12) United States Patent
Bobb

(10) Patent No.: US 6,220,553 B1
(45) Date of Patent: Apr. 24, 2001

(54) RAILROAD SWITCH STAND

(76) Inventor: Frank P. Bobb, 3475 Green St., Camp Hill, PA (US) 17011

( * ) Notice: Subject to any disclaimer, the term of this patent is extended or adjusted under 35 U.S.C. 154(b) by 0 days.

(21) Appl. No.: 09/293,807

(22) Filed: Apr. 19, 1999

(51) Int. Cl.[7] ..... B61L 5/02

(52) U.S. Cl. ..... 246/393; 246/358; 246/382; 246/415 R; 246/476

(58) Field of Search ..... 246/358, 382, 246/387, 389, 392, 393, 407, 412, 413, 428, 415, 476, 405

(56) References Cited

U.S. PATENT DOCUMENTS 175,743 * 4/1876 Peeples ..... 246/392
269,958 * 1/1883 Pinney ..... 246/405
401,671 * 4/1889 Alkins ..... 246/393
411,998 * 10/1889 Newman ..... 246/392

* cited by examiner

*Primary Examiner*—S. Joseph Morano
*Assistant Examiner*—Frantz F. Jules
(74) *Attorney, Agent, or Firm*—Richard O. Church

(57) ABSTRACT

An improvement in a railroad switch stand of the general type in which a vertical spindle is mounted for rotation within a switch stand housing, a horizontally extending connecting rod is operatively connected at its one end to railroad switch points and at its other end to a crank, the crank is carried by a hub, the hub is mounted at the lower end of the spindle for rotation with the spindle and the hub is held in a fixed vertical position on the spindle by means of a cross pin that passes diametrically through the spindle and the hub. The improvement of the invention being a safety plate positioned immediately below the spindle to prevent the hub from sliding off of the spindle should the cross pin fail.

1 Claim, 2 Drawing Sheets

RAILROAD SWITCH STAND

FIELD OF THE INVENTION

The present invention relates to railroad switch stands for moving a pair of switch points between two rails and diverting rolling stock from one track to another. More particularly, this invention relates to railroad switch stands that can remain operable after certain types of mechanical failures.

DESCRIPTION OF THE PRIOR ART

In switching rolling stock from one set of rails to another, a pair of stationary rails and a pair of switching rails are arranged so that the switching rails can be moved either to keep trains on a main track or divert them to a branch track. The switching rails are moved by a switching device which includes a connecting rod extending horizontally beneath the tracks that is connected to the switching rails.

The switching device typically includes a switch stand at one side of the rails which can be operated either manually or automatically. When operated by hand, a weighted lever arm lying horizontally on the ground or at the base of the switch stand can be lifted and thrown through an arc of 180° to the opposite side of the switch stand where it again will rest horizontally on the ground or base. The mechanism of the switch stand converts the rotational movement of the lever arm into the linear movement of the connecting rod which, in turn, controls the movement of the switching rails.

SUMMARY OF THE INVENTION

The principle object of this invention is to maintain a switch stand in operative condition if certain of the mechanical elements of the switch become disassociated from each other.

Another object of this invention is to provide means to permit a faulty switch stand to remain in operation until it can be repaired.

BRIEF DESCRIPTION OF THE DRAWINGS

These and other objects of this invention can be understood by reference to the accompanying drawings in which.

DETAILED DESCRIPTION OF THE DRAWINGS

Figure 1:
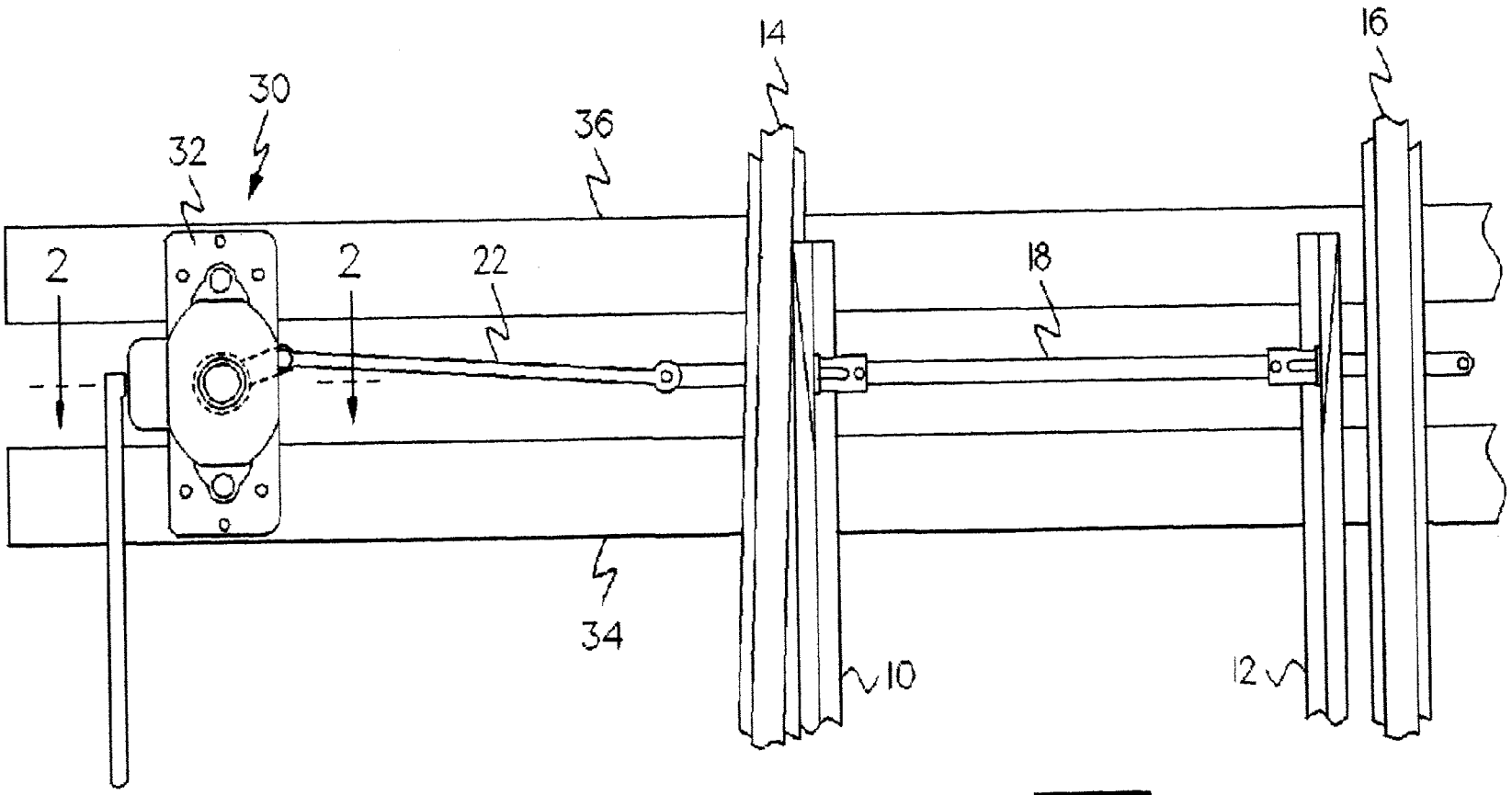
FIG. 1 is a plan view of a pair of stock rails and a pair of switch points illustrating the connection of the switch points to a switch stand via a connecting rod.

Turning to FIG. 1 of the drawings it may be observed that a pair of switch points 10 and 12 lie between a pair of stock rails 14 and 16. The switch points 10 and 12 are connected by a laterally extending switch rod 18. A connecting rod 22 serves to link the switch rod 18 to a switch stand 30. The switch stand 30 has a base 32 which enables mounting the stand on a pair of adjacent railroad ties 34 and 36.

In the operating position of the switch stand 30 as depicted in FIG. 1, the switch point 10 rests against the stock rail 14. Upon operation of the switch stand 30 to its second operating position the connecting rod 22 and the switch rod 18 are moved to the right such that the switch point 10 moves away from the stock rail 14 and switch point 12 is moved into contact with stock rail 16. Thus, it may be understood that operation of the switch stand 30 between its two operating positions causes the connecting rod 22 to be extended in one direction to move the switch rod 18 and the switch points 10 and 12 from a position in which one switch point lies against one stock rail to a position in which the opposite switch point lies against the opposite stock rail.

Figure 2:
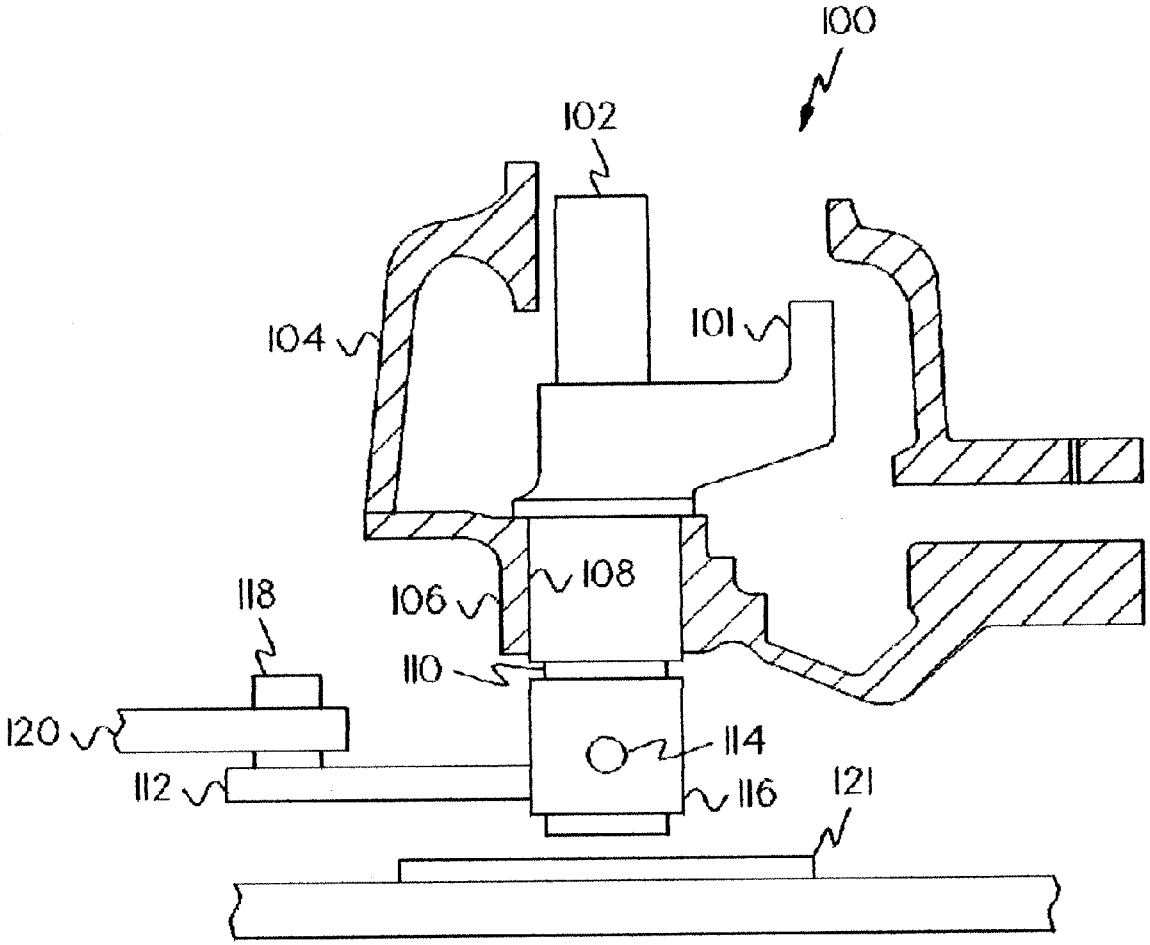
FIG. 2 is a side view, partially in section, taken along section lines 2—2 of FIG. 1 illustrating a switch stand made in accordance with this invention.

FIG. 2 illustrates a portion of the working mechanisms of the switch stand 100 which enables switching rolling stock from one set of rails to another. Quite generally the switch stand 100 supports a spindle 102 which terminates at its lower in a stub shaft 110. A crank 112 is mounted on the distal end of the stub shaft and is mechanically linked to the stub shalt 110 by means of hub 116. The hub 116 is pinned to the stub shaft 110 by a cross pin 114 that passes diametrically through the hub 116 and the stub shaft 110. The cross pin is not intended to transmit turning forces but only holds the hub 116 in proper vertical alignment with the stub shaft 110. Were it not for the cross pin 114 the hub 116 could work its way downwardly on the stub shaft 110 until it became detached from the stub shaft 110 and the crank 112 could not be moved.

While not illustrated in the drawings it should be noted that the stub shaft 110 is of rectilinear cross section with flat outer surfaces that mate with similar flat surfaces on the inner surfaces of the hub 116. These flat surfaces key the stub shaft 110 to the hub 116 and transmit rotational motion from the stub shaft 110 directly to the hub 116 which, in turn, causes rotation of the crank 112. An upstanding shaft 101 is linked to the rotational mechanism and transmits the turning force to the spindle 102.

The spindle 102 is surrounded by a housing 104. A portion of the housing 104 is utilized as a sleeve bearing 106 which enables the spindle 102 and its machined surface 108 to rotate in the sleeve bearing 106.

The motive force used to rotate the spindle is of no particular consequence in the practice of this invention. Thus a hydraulic or an electric motor may be used to rotate the spindle 102. More conventionally, however, switch stands include a gear segment mounted at a right angle to the end of an operating lever (not shown) which engages a pinion gear (not shown) mounted on the shaft 101 that can be rotated through an arc of 180° to change the position of the switch points. The operating lever may be weighted at its free end—typically with a 20 or 30 pound weight—which insures that when manually operated from one position to another, the lever arm will seat in either the open or thrown position. A foot operated latch mechanism may be provided to secure the lever arm in its fixed position.

When the stub shaft 110 is rotated, the crank 112 will rotate with it and in turn, through an upstanding boss 108 the connecting rod 120 will be caused to move in essentially a linear manner to move the switch point from one position to another.

As described above, the crank 112 is held on the stub shaft 10 by means of a cross pin 114 that prevents the crank 112 from sliding down off of the stub shaft 110. On occasions, as when the cross pin 114 is damaged or loosened, it may work its way out of the cross pin hole. If this occurs, the hub 116 will not be supported and the hub 116 and its crank 112 will be free to work their way down, with the aid of gravity, until they slip off and become disassociated with the end of the stub shaft. When the crank 112 and its hub 116 are no longer associated with the stub shaft 110, rotation of the spindle 102 will not be translated into a movement of the connecting rod 112 and the railroad switch stand will not be operable.

In the practice of this invention a safety support 121, which is shown in the drawing as a "U" shaped piece of metal, is mounted on the base of the switch stand. The safety support 121 is spaced slightly below the bottom of the stub shaft 110. The spacing is such that if the cross pin 114 becomes dislodged, the hub 116 will be limited in its downward travel as it comes rest on the top surface of the safety support 121 and thus be prevented from disengaging from the stub shaft 110. By these means, the continued operation of the switch stand will be assured. When the next routine inspection occurs, it can be observed that the cross pin 114 is no longer supporting the hub 116 on the stub shaft 10 and a new cross pin can be installed to restore the shift stand to its normal operation.

In a slightly different modification of the invention, the safety support is inverted and is mounted to depend from the housing 104. It is of no consequence whether the safety support is mounted from above or below as it will function in an identical manner.

From the foregoing it can be understood that this invention provides a safety support to prevent the hub of a crank from becoming disassociated from the operating spindle of a switch stand.

I claim:

1. In a railroad switch stand adapted to move switch points which includes:

a vertically disposed spindle mounted within a housing for rotation about the elongated axis of the spindle;

a stub shaft located at the lower end of the spindle;

a hub mounted in surrounding relationship to the stub shaft for rotation with the stub shaft;

a crank secured at one of its ends to the hub and extending radially outwardly from the hub;

a boss located near the outer end of the crank for attachment to a connecting rod operatively located between the boss and the switch points;

a cross pin passing diametrically through the stub shaft and the hub to secure the axial position of the hub on the stub shaft; the improvement comprising:

a safety support mounted within the housing immediately subjacent the lower end of the stub shaft adapted to restrain the hub from becoming mechanically disassociated from the shaft if the cross pin fails to function.

* * * * *